US011857124B1

(12) United States Patent
Feldman

(10) Patent No.: US 11,857,124 B1
(45) Date of Patent: Jan. 2, 2024

(54) HAIR DISCARD DEVICE

(71) Applicant: Margaret Feldman, Alexandria, VA (US)

(72) Inventor: Margaret Feldman, Alexandria, VA (US)

( * ) Notice: Subject to any disclaimer, the term of this patent is extended or adjusted under 35 U.S.C. 154(b) by 0 days.

(21) Appl. No.: 17/832,947

(22) Filed: Jun. 6, 2022

Related U.S. Application Data

(60) Provisional application No. 63/202,282, filed on Jun. 4, 2021.

(51) Int. Cl.
*A47K 3/28* (2006.01)
*E03C 1/264* (2006.01)

(52) U.S. Cl.
CPC ..... *A47K 3/281* (2013.01); *E03C 1/264* (2013.01)

(58) Field of Classification Search
CPC ..... A47K 3/281
See application file for complete search history.

(56) References Cited

U.S. PATENT DOCUMENTS 3,373,457 A 3/1968 Rouch, Jr.
4,713,274 A * 12/1987 Minor ..... A47L 25/005 428/912.2
6,458,442 B1 * 10/2002 McKay ..... A47L 23/266 428/101
7,407,142 B1 8/2008 Lopez
9,131,810 B2 9/2015 Reile
10,219,606 B1 3/2019 Boncimino et al.
10,765,198 B2 9/2020 Watne et al.
10,791,819 B2 * 10/2020 Caccamise ..... A45D 44/16
2002/0083964 A1 7/2002 McKay
2007/0136966 A1 * 6/2007 Aubourg ..... A47L 25/005 15/104.002
2008/0196186 A1 8/2008 Vidmar et al.
(Continued)

*Primary Examiner* — Christine J Skubinna
(74) *Attorney, Agent, or Firm* — Craige Thompson; Thompson Patent Law; Timothy D. Snowden

(57) ABSTRACT

A device and the method of use thereof to easily collect unwanted discarded hair in a shower or bath that provides a means for preventing the collection of unwanted hair on shower walls or in shower drains. The device aesthetically blends in to the environment and easily adheres to a shower wall. The device includes a base sheet, which contains a double sided adhesive with one side that adheres to the shower wall, i.e., the wall side. The other side allows for the adherence thereto of a plurality of individual adhesive disposable sheets which have two sides, but with pressure sensitive adhesive found only on the front side, onto which discarded hair can easily be adhered to, trapped and discarded later. Each individual adhesive, disposable sheet contains the pressure sensitive adhesive across the majority of the front face, but leaves a reserved area on each sheet without adhesive. This allows for each individual adhesive disposable sheet to be easily grasped by a user and separated from the adjacent sheet behind it. A front sheet covers the entire stack of sheets and contains no adhesive, but which can be easily removed to reveal the sticky front faces of the plurality of disposable sheets underneath it. The device can be water resistant and/or substantially transparent to allow for an aesthetic blending into the shower or bath environment.

12 Claims, 4 Drawing Sheets

(56) References Cited

U.S. PATENT DOCUMENTS

| | | | | |
|---|---|---|---|---|
| 2013/0154248 | A1* | 6/2013 | Knudsen | B42D 1/00 281/20 |
| 2016/0309886 | A1 | 10/2016 | Oldham | |
| 2018/0064233 | A1 | 3/2018 | Riley | |
| 2018/0146838 | A1 | 5/2018 | Thomas | |
| 2018/0250975 | A1 | 9/2018 | Knudsen | |
| 2019/0023053 | A1* | 1/2019 | Bodziak | B42D 5/003 |
| 2020/0046104 | A1 | 2/2020 | Lopez | |
| 2020/0315407 | A1 | 10/2020 | Kennedy | |
| 2021/0186271 | A1* | 6/2021 | LaGuardia | B32B 27/32 |

* cited by examiner

HAIR DISCARD DEVICE

REFERENCE TO PRIOR APPLICATION

This application claims priority of the provisional patent application 63/202,282, filed Jun. 4, 2021 entitled HAIR DISCARD DEVICE by Margaret Feldman.

FIELD OF THE INVENTION

The present invention relates to a device that collects and removes loose hair, typically in a shower or other location where hair is being washed or would otherwise have cause to need to be discarded. More specifically, the device of the instant invention is a hair retaining device that is attachable to a shower wall or other surface with multiple disposable sheets for collecting and removing hair from the location.

DESCRIPTION OF THE PRIOR ART

Individuals will naturally lose fifty to one-hundred hairs a day. Some individuals may lose even more hair due to weight loss, giving birth, increased stress, high fever, illness or undergoing other medical operations. While showering, individuals commonly shed excessive hair. Individuals, particularly those with long hair, may collect loose strands of hair between their fingers while shampooing and conditioning. Once the hair is collected in one's hand during a shower, one may try to stick the hair on the shower wall to prevent the hair from falling into and clogging the shower drain. The challenge with placing the hair on the shower wall is the hair may not stick easily to the shower wall and still slip down into the drain. If the hair does stick to the shower wall, it may dry and fall off into the drain at a later time after the user has exited the shower. If the dry hair does stay on the shower wall, the hair strands are unsightly to others who share the same bathroom space thereafter. Flair that is not properly disposed of outside of the shower, can inadvertently fall off the wall and gather in the drain and create unwanted clogs and backups. Clogs inhibit proper drainage, creating unwanted floods and can cause unsightly, ill-smelling hair snares that have to be removed from the drain. For severe clogs, professional plumbing services may be required to remove the clog. Professional plumbing services can be costly and may use harsh chemicals to disintegrate the clog.

U.S. Pat. No. 10,219,606 to Boncimino, et al. discloses a hair collection device having a two-sided foam pad for collection of hairs. Once the foam pad is full of hair, the user has to either leave the foam pad with hair in it up for future uses and visible to those who share the shower area or the user has to throw out the foam pad entirely and replace it with a brand-new pad thereafter. The patent also discloses a fastener made of hook and loop material which could leave residue on the shower wall.

U.S. Pat. No. 10,765,198 to Watne, et al. discloses a hair collection device with tentacle clusters with finger rows for sliding fingers through to discard loose hair strands. Cleaning such a device would be cumbersome because it requires the user to grab hairs from the different tentacles similar to cleaning out a traditional hair brush. If the hair is not cleaned immediately, it will remain on the device for the next user to see.

U.S. Pat. No. 9,131,810 to Reile discloses a hair collection system that contains a backboard for hair collection as well as a basin and an attachment means to the shower wall.

The basin protrudes from the wall, and is not low-profile. The hair caught in the hand also may not easily attach to the backboard.

A strong need exists for individuals to have a convenient and effective place to collect and discard unwanted loose hairs, particularly while showering. Therefore, what is needed are devices and methods of use thereof that overcome the above-mentioned disadvantages inherent in the prior art.

SUMMARY OF THE INVENTION

The basic embodiment of the present invention teaches a hair discard device comprising: a substantially planar base sheet, said substantially planar base sheet having a front side and a back side, said substantially planar base sheet further comprising: said back side being covered substantially but not entirely with pressure sensitive adhesive with a reserved area extending along a portion of said back side wherein said back side is covered with a protective backing until ready to use; said front side being covered substantially but not entirely with a pressure sensitive adhesive with a reserved area extending along a portion of said front side of said planar base sheet that is not covered with any pressure sensitive adhesive; a plurality of individual, substantially planar, adhesive sheets each having a front side and a back side, said plurality of individual, substantially planar, adhesive sheets further comprising: no adhesive on each said back side; pressure sensitive adhesive across of most of said front side but wherein a reserved area that contains no adhesive thereby providing a gripping point to separate each of said plurality of individual, planar, adhesive sheets from each other by a user when said user grasps a portion of said reserved area; wherein said substantially planar base sheet and said plurality of individual, substantially planar, adhesive sheets are all stacked on top of each other forming a streamlined look of a single planar device with a low profile.

The above embodiment can be further modified by defining that said device further comprises a substantially planar protective front sheet, said substantially planar protective front sheet having no adhesive thereon, said substantially planar protective front sheet being removable when ready to use.

The above embodiment can be further modified by defining that said plurality of individual, substantially planar, adhesive sheets are water resistant.

The above embodiment can be further modified by defining that said plurality of individual, substantially planar, adhesive sheets are substantially transparent.

The above embodiment can be further modified by defining that said substantially planar base sheet includes indicia indicating which side is the side to be adhered to a shower wall.

The above embodiment can be further modified by defining that said substantially planar protective front sheet includes indicia indicating that it is the side onto which discarded hair is to be adhered.

An alternate embodiment of the instant invention teaches a method of collecting for later discarding of hair in a shower or bath comprising the steps of: acquiring a hair discard device, said hair discard device further comprising: a substantially planar base sheet, said substantially planar base sheet having a front side and a back side, said substantially planar base sheet further comprising: said back side being covered substantially but not entirely with pressure sensitive adhesive with a reserved area extending along a portion of said back side wherein said back side is covered with a protective backing until ready to use; said front side being covered substantially but not entirely with a pressure sensitive adhesive with a reserved area extending along portion of said front side of said planar base sheet that is not covered with any pressure sensitive adhesive; a plurality of individual, substantially planar, adhesive sheets each having a front side and a back side, said plurality of individual, substantially planar, adhesive sheets further comprising: no adhesive on each said back side; pressure sensitive adhesive across of most of said front side but wherein a reserved area that contains no adhesive thereby providing a gripping point to separate each of said plurality of individual, planar, adhesive sheets from each other by a user when said user grasps a portion of said reserved area; wherein said substantially planar base sheet and said plurality of individual, substantially planar, adhesive sheets are all stacked on top of each other forming a streamlined look of a single planar device with a low profile; removing said protective coating from said back side of said substantially planar base sheet; adhering said back side of said substantially planar base sheet to a wall of a shower; collecting discarded hair; attaching said discarded hair to said top sheet from said plurality of individual, substantially planar, adhesive sheets; gripping said top sheet from said plurality of individual, substantially planar, adhesive sheets along said reserved area thereby separating said top sheet from an adjacent sheet thereunder; separating said top sheet from said adjacent sheet; discarding said top sheet such that said adjacent sheet then becomes the top sheet.

The above embodiment can be further modified by defining that said hair discard device further comprises a substantially planar protective front sheet, said substantially planar protective front sheet having no adhesive thereon, said substantially planar protective front sheet being removable when ready to use wherein said method further comprises the further step of removing said substantially planar protective front sheet thereby exposing a top sheet from said plurality of individual, substantially planar, adhesive sheets away from said shower wall.

The above embodiment can be further modified by defining that said plurality of individual, substantially planar, adhesive sheets are water resistant.

The above embodiment can be further modified by defining that said plurality of individual, substantially planar, adhesive sheets are substantially transparent.

The above embodiment can be further modified by defining that said substantially planar base sheet includes indicia indicating which side is the side to be adhered to a shower wall.

The above embodiment can be further modified by defining that said substantially planar front sheet includes indicia indicating which side is the side onto which discarded hair is to be adhered.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
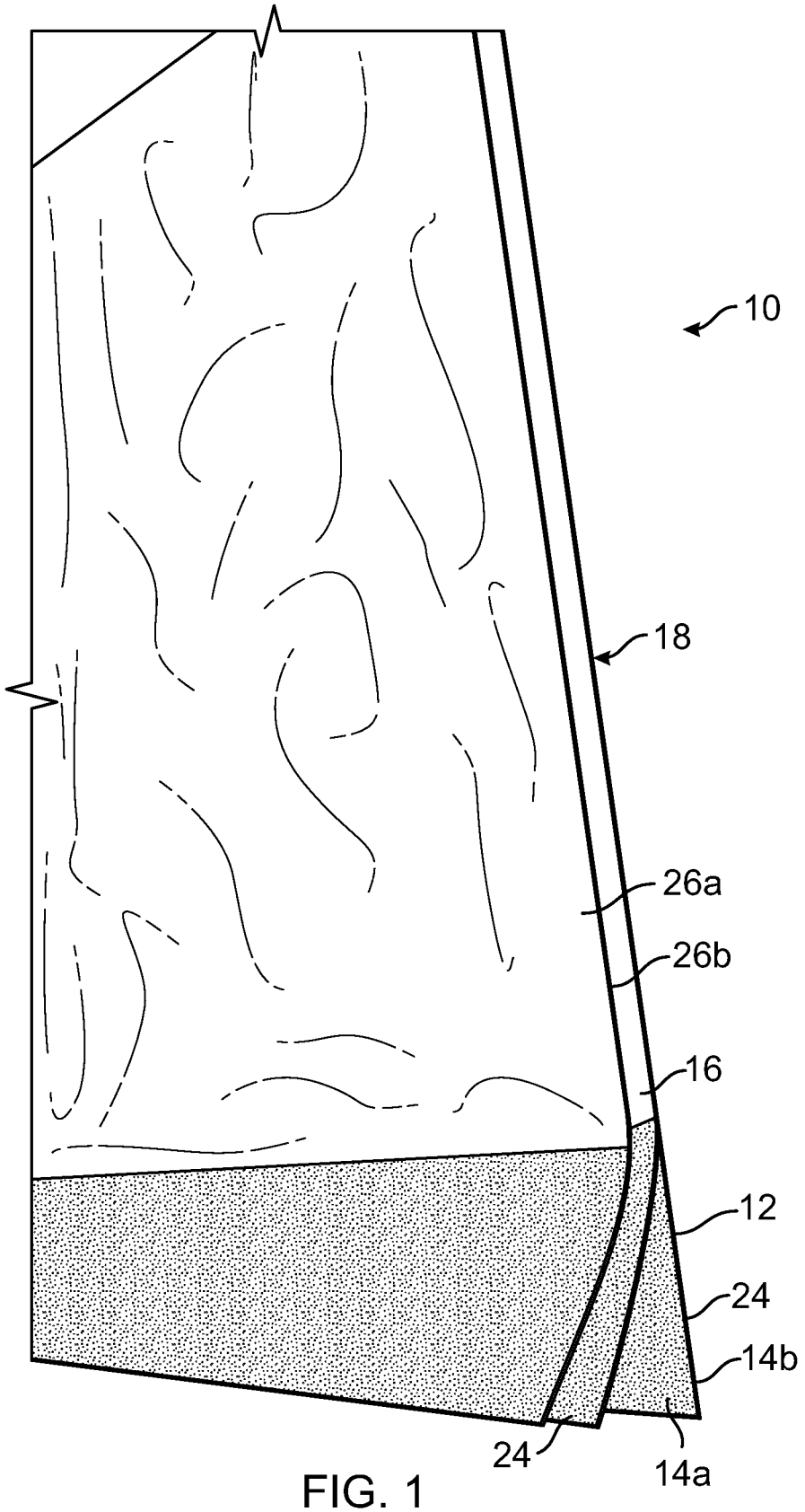
FIG. 1 is a cropped side perspective view of the device of the instant invention.
Figure 2:
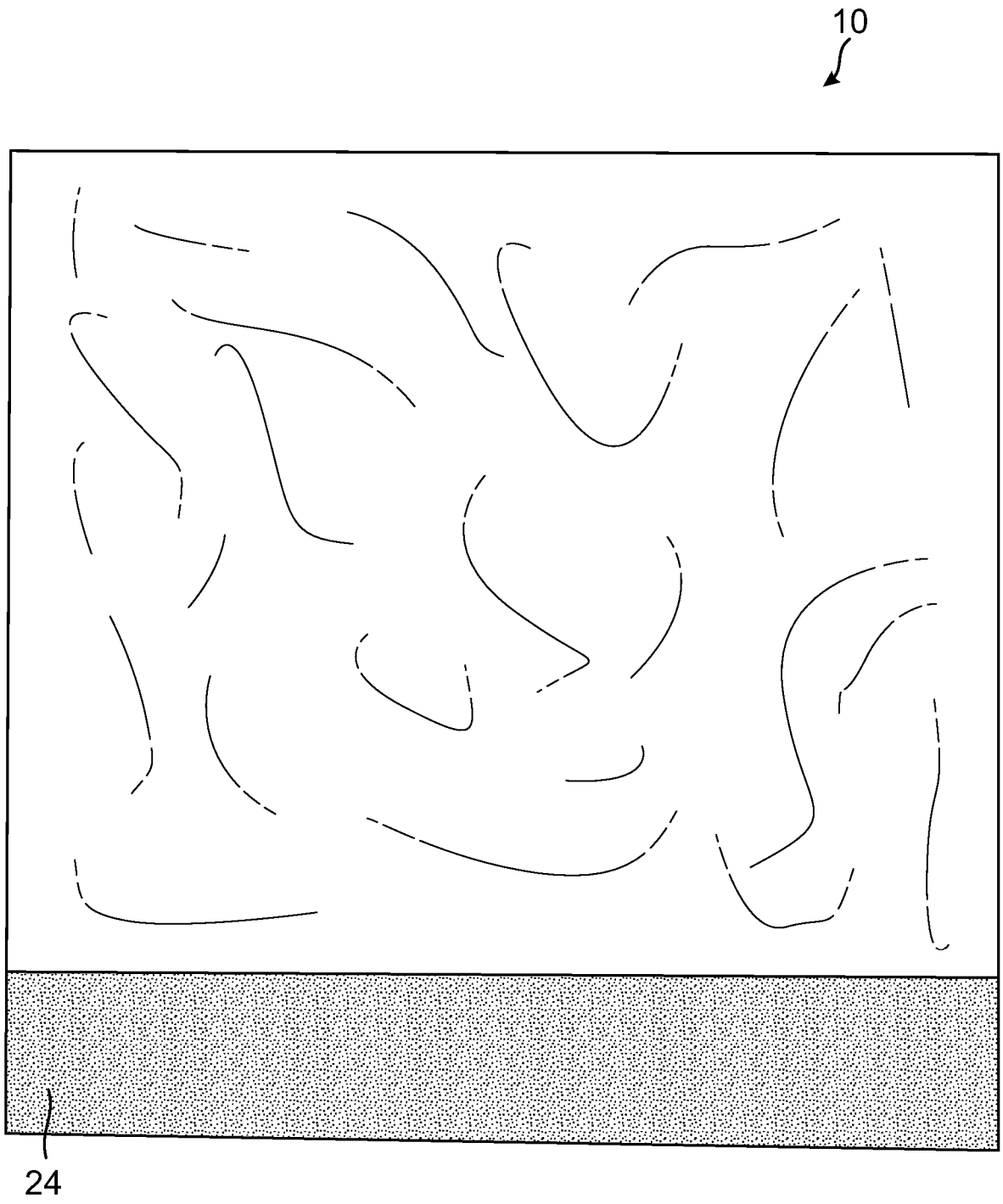
FIG. 2 is a front view of the entire device of the instant invention.
Figure 3:
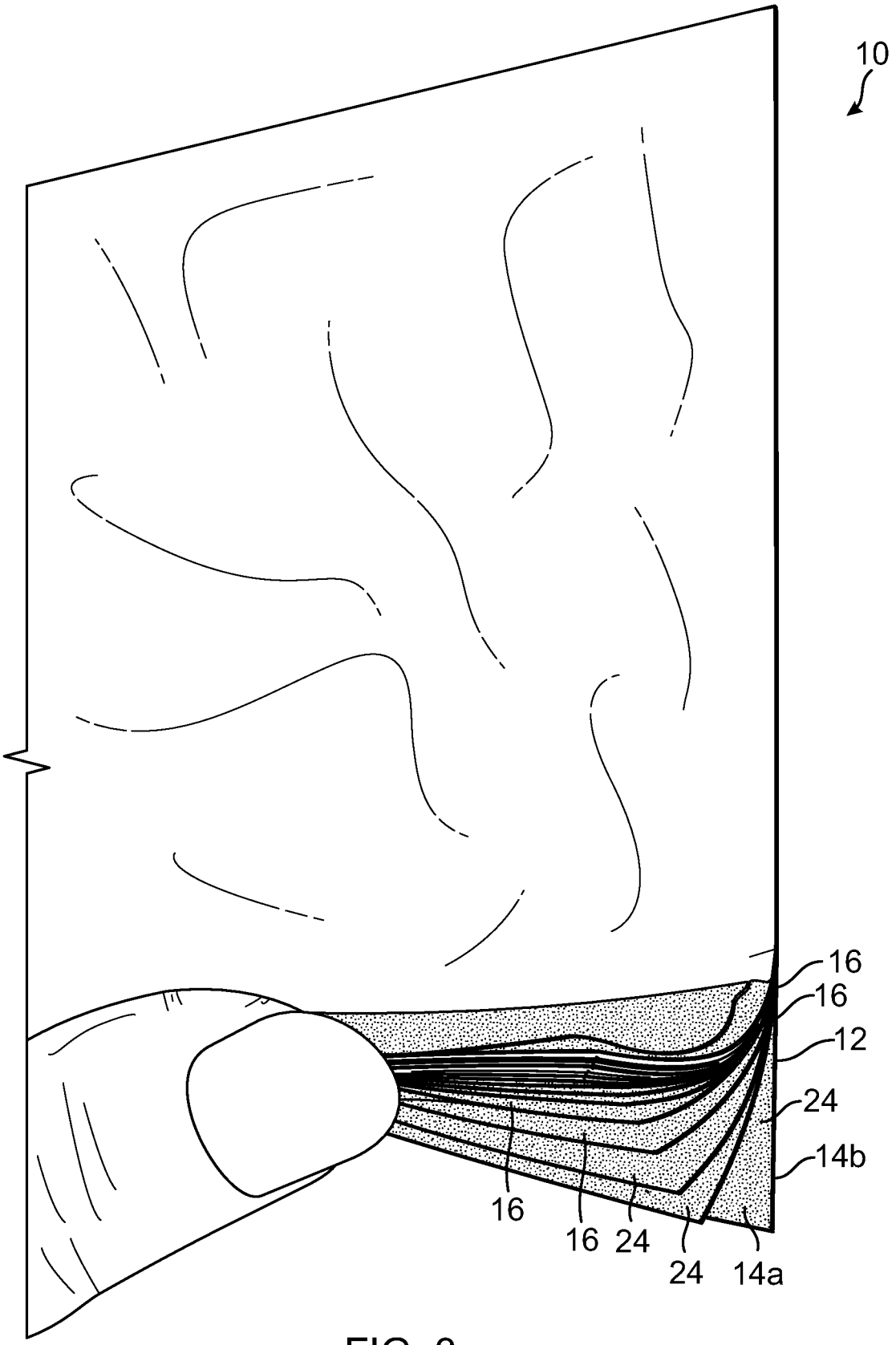
FIG. 3 is a cropped side perspective view of the device of the instant invention as shown in FIG. 1, but with a user's thumb showing how each sheet is separable, i.e., not adhered to, each adjacent sheet.
Figure 4:
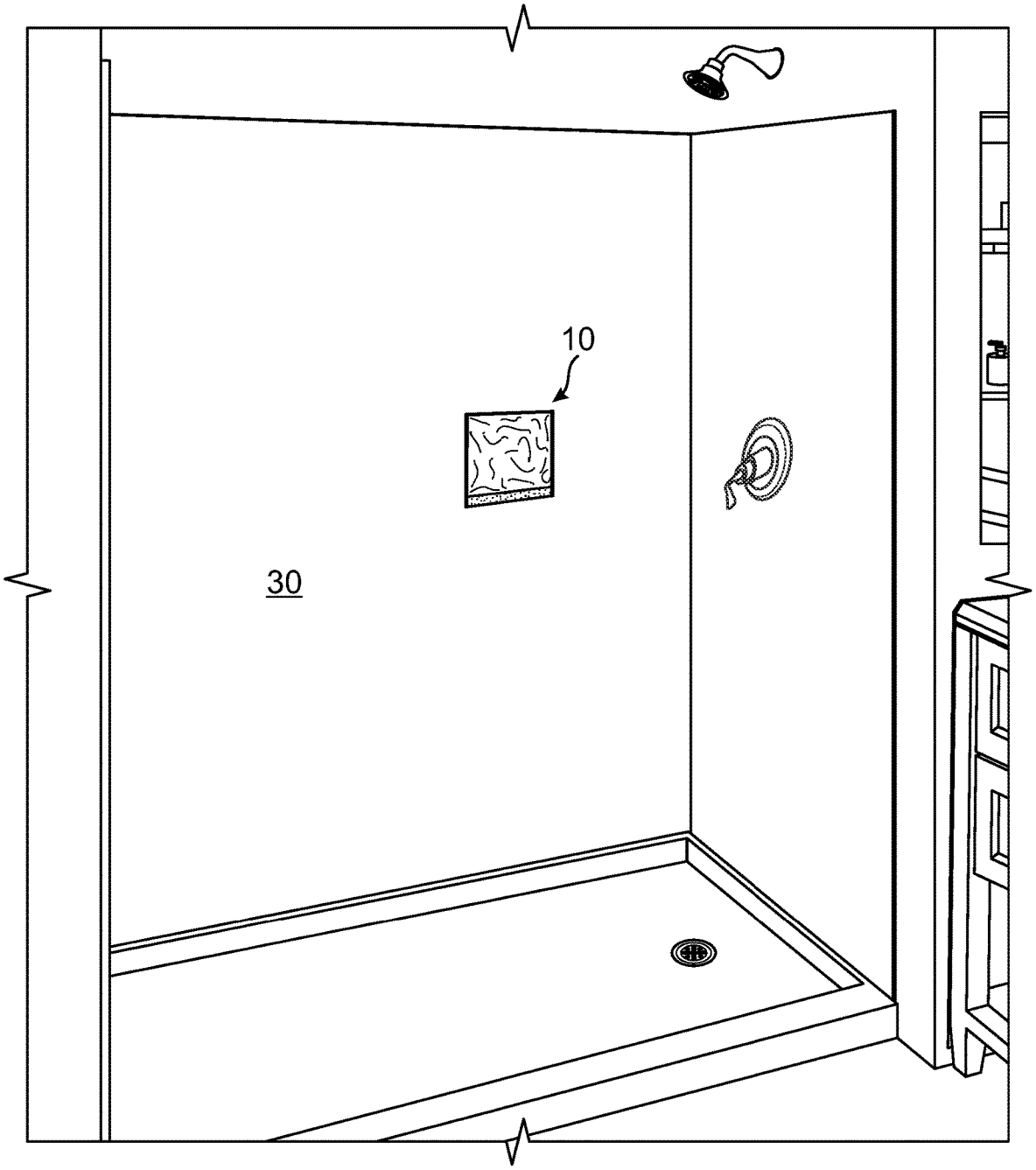
FIG. 4 is an environmental view of a shower with the device of the instant invention attached to shower wall therein.

Turning to the drawings, the preferred embodiment is illustrated and described by reference characters that denote similar elements throughout the several views of the instant invention.

The present invention provides a hair discard device 10 consisting of a base sheet 12 that has a front side 14A and a back side 14B. The back side 14B of the base sheet 12 would have a removable cover 18 that would reveal the pressure sensitive adhesive applied to the base sheet 12. This back side 14B of the base sheet 12 attaches to a shower wall 30. Attached to the base sheet 12 is a plurality of individual disposable sheets 16 to collect discarded hair. Each individual, disposable sheet 16 has a front side 26A and a back side 26B. The front side 26A of each individual, disposable sheet 16 as well as the base sheet 12 is covered substantially with pressure sensitive adhesive on to which discarded hair can adhere and collect. Along the bottom or other portion of each individual, disposable sheet 16 is a band 24 or other defined area that does not contain adhesive. These bands 24 on each individual disposable sheet 16 as well as the base sheet 12 allows for the easy separation of each individual disposable sheet 16 from the next adjacent sheet 16 since it does not contain any adhesive. This allows for a sleek look wherein the device does not have any extruding tabs extending outward therefrom in order to separate the individual disposable sheets 16.

Each individual, disposable sheet 16 stacked in the device 10, due to the adhesive coating on the front side 26A allows a user to easily place the wet hair caught in their fingers while showering onto the top sticky sheet 16 for hair strand consolidation and safekeeping until removal. The adhesive disposed on the sticky sheet ensures the hair will not fall off the shower wall 30, even if the hair dries after the user has exited the shower 30. Each individual disposable sheet 16 may be easily removed off of the pad through grasping of the non-adhesive band 24 when leaving the shower to prevent other shower users from seeing the unsightly hair. If hair is left on the sheet and not removed from the shower by mistake, the next user in the shower may quickly and easily dispose of the hair that is already consolidated on the front 26A of the adhesive disposable sheet 16 before starting the showering process. Once an individual sheet 16 is removed, a new adhesive sheet 16 is revealed and ready for use until all of the sheets 16 in said device 10 have been used. When the device 10 does finally use the last adhesive disposable sheet which is the base sheet 12, the device has now run out of adhesive sheets, and the base sheet 12 is then removed from the shower wall 30 and a new replacement device 10 containing multiple adhesive sheets 16 may be reattached to the shower wall. Having a device 10 with multiple adhesive sheets 16 attached thereto allows a user to utilize one device 10 for multiple uses of hair removal, without the need to completely replace the device 10.

The invention proactively prevents hair from getting in the shower drain, preventing odorous and unsightly clogs, and the need for expensive plumbing services and/or the use of strong chemicals.

The unit is low profile and planar to the shower wall 30, taking up minimal space and won't easily get inadvertently knocked down. The device 10, the backing sheet 12, the individual disposable sheets 16 and a protective front sheet can all be water resistant. The protective front sheet covers the individual disposable sheets 16 and can be designated as the "hair side" with some sort of indicia. Likewise, the protective base sheet 12 would include some sort of indicia to indicate that it is the "wall side". Preferably, the device 10 and all its components could be substantially transparent once adhered to the shower wall 30 so that it blends in, save some small markings for trademarks and the indicia mentioned above as to which side is the hair side and which side is the wall side. The indicia will be on the protective front sheet and the protective backing 18 on the base sheet 12, so that once these sheets are removed for use, the indicia will no longer exist on the device 10 itself or be visible on the shower wall 30. The device should be compatible with common shower or bathtub finishes, given the water resistant adhesive on the base sheet 12.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions mar be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A hair discard shower device consisting of a disposable pad, the disposable pad comprising:

a substantially planar base sheet, said substantially planar base sheet having a front side and a back side, said substantially planar base sheet further comprising:

said back side being covered substantially but not entirely with pressure sensitive adhesive with a reserved area extending along a portion of said back side wherein said back side is covered with a protective backing until ready to use, the pressure sensitive adhesive being configured to releasably adhere directly to a wall of a washing area and be entirely removed without leaving residue;

said front side being covered substantially but not entirely with a pressure sensitive adhesive with a reserved area extending along a portion of said front side of said planar base sheet that is not covered with any pressure sensitive adhesive, the pressure sensitive adhesive configured to couple to other sheets and to hair;

a plurality of individual, substantially planar, adhesive sheets each having a front side and a back side, said plurality of individual, substantially planar, adhesive sheets further comprising:

no adhesive on each said back side;

pressure sensitive adhesive across of most of said front side but wherein a reserved area that contains no adhesive thereby providing a gripping point to separate each of said plurality of individual, planar, adhesive sheets from each other by a user when said user grasps a portion of said reserved area;

wherein said substantially planar base sheet and said plurality of individual, substantially planar, adhesive sheets are all stacked on top of each other forming a streamlined look of a single planar device with a low profile.

2. The device as defined in claim 1 further comprising a substantially planar protective front sheet, said substantially planar protective front sheet having no adhesive thereon, said substantially planar protective front sheet being removable when ready to use.

3. The device as defined in claim 1 wherein said plurality of individual, substantially planar, adhesive sheets are water resistant.

4. The device as defined in claim 1 wherein said substantially planar base sheet includes indicia on the protective backing indicating which side is the side to be adhered to a washing area wall, wherein the indicia is not visible once the device is adhered to the washing area wall.

5. The device as defined in claim 4, further comprising a substantially planar protective front sheet, said substantially planar protective front sheet having no adhesive thereon, said substantially planar protective front sheet being removable when ready to use, wherein said substantially planar protective front sheet includes indicia indicating that it is the side onto which discarded hair is to be adhered, wherein the indicia is not visible once hair is adhered to the device.

6. The device as defined in claim 5 wherein said plurality of individual, substantially planar, adhesive sheets are substantially transparent, and the disposable pad is arranged and configured such that, when the disposable pad is adhered to the washing area wall, the disposable pad extends planar with the surface of the washing area wall to present a single, substantially transparent, planar device on the washing area wall.

7. A method of collecting for later discarding of hair in a shower or bath comprising the steps of:

acquiring a hair discard shower device consisting of a disposable pad, said hair discard shower device further comprising:

a substantially planar base sheet, said substantially planar base sheet having a front side and a back side, said substantially planar base sheet further comprising:

said back side being covered substantially but not entirely with pressure sensitive adhesive with a reserved area extending along a portion of said back side wherein said back side is covered with a protective backing until ready to use, the pressure sensitive adhesive being configured to releasably adhere directly to a washing area wall and be entirely removed without leaving residue;

said front side being covered substantially but not entirely with a pressure sensitive adhesive with a reserved area extending along a portion of said front side of said planar base sheet that is not covered with any pressure sensitive adhesive, the pressure sensitive adhesive configured to couple to other sheets and to hair;

a plurality of individual, substantially planar, adhesive sheets each having a front side and a back side, said plurality of individual, substantially planar, adhesive sheets further comprising:

no adhesive on each said back side;

pressure sensitive adhesive across of most of said front side but wherein a reserved area that contains no adhesive thereby providing a gripping point to separate each of said plurality of individual, planar, adhesive sheets from each other by a user when said user grasps a portion of said reserved area;

wherein said substantially planar base sheet and said plurality of individual, substantially planar, adhesive sheets are all stacked on top of each other forming a streamlined look of a single planar device with a low profile;

removing said protective backing from said back side of said substantially planar base sheet;

adhering said back side of said substantially planar base sheet to a wall of a shower;

collecting discarded hair;

attaching said discarded hair to said top sheet from said plurality of individual, substantially planar, adhesive sheets;

gripping said top sheet from said plurality of individual, substantially planar, adhesive sheets along said reserved area thereby separating said top sheet from an adjacent sheet thereunder;

separating said top sheet from said adjacent sheet;

discarding said top sheet such that said adjacent sheet then becomes the top sheet.

8. The method as defined in claim 7 wherein said hair shower discard device further comprises a substantially planar protective front sheet, said substantially planar protective front sheet having no adhesive thereon, said substantially planar protective front sheet being removable when ready to use wherein said method further comprises the further step of removing said substantially planar protective front sheet thereby exposing a top sheet from said plurality of individual, substantially planar, adhesive sheets away from said washing area wall.

9. The method as defined in claim 7 wherein said plurality of individual, substantially planar, adhesive sheets are water resistant.

10. The method as defined in claim 7 wherein said plurality of individual, substantially planar, adhesive sheets are substantially transparent.

11. The method as defined in claim 7 wherein said substantially planar base sheet includes indicia indicating which side is the side to be adhered to a washing area wall.

12. The method as defined in claim 8 wherein said substantially planar front sheet includes indicia indicating which side is the side onto which discarded hair is to be adhered.

* * * * *